US006764397B1

(12) United States Patent
Robb

(10) Patent No.: US 6,764,397 B1
(45) Date of Patent: Jul. 20, 2004

(54) METHOD AND APPARATUS FOR CASINO MACHINE GAMING SYSTEM

(75) Inventor: Robert W. Robb, Orem, UT (US)

(73) Assignee: Skill Safari, LLC, San Mateo, CA (US)

( * ) Notice: Subject to any disclaimer, the term of this patent is extended or adjusted under 35 U.S.C. 154(b) by 0 days.

(21) Appl. No.: 09/545,987

(22) Filed: Apr. 10, 2000

Related U.S. Application Data

(63) Continuation-in-part of application No. 09/481,726, filed on Jan. 11, 2000, now Pat. No. 6,488,580.

(51) Int. Cl.[7] ..... A63F 9/24

(52) U.S. Cl. ..... 463/23; 700/92; 340/323 R

(58) Field of Search ..... 463/1, 9, 12–13, 463/16, 20, 25, 29–30, 36, 40–42, 43; 273/138.1, 138.2, 139, 143 R, 292–293, 236–237, 309; 340/323 R; 700/91–93

(56) References Cited

U.S. PATENT DOCUMENTS 4,129,304 A 12/1978 Mager
4,582,324 A 4/1986 Koza et al.
4,685,677 A 8/1987 Demar et al. ..... 273/121 A
5,342,049 A 8/1994 Wichinsky et al.
5,370,399 A * 12/1994 Liverance
5,542,669 A 8/1996 Charron et al.
5,718,429 A 2/1998 Keller, Jr.
5,741,011 A 4/1998 So et al.
5,779,549 A 7/1998 Walker et al.
5,816,918 A 10/1998 Kelly et al.
5,823,872 A 10/1998 Prather et al.
5,851,147 A 12/1998 Stupak et al.
5,879,007 A 3/1999 Kasri
5,882,258 A 3/1999 Kelly et al.
5,961,386 A 10/1999 Sawaguchi
6,007,426 A 12/1999 Kelly et al.
6,092,806 A 7/2000 Follis
6,238,288 B1 * 5/2001 Walker
6,488,580 B1 * 12/2002 Robb

* cited by examiner

*Primary Examiner*—Mark Sager

(57) ABSTRACT

The invention is directed to a method of calculating a payout for a machine based game, comprising choosing a time period over which a measurement will occur, measuring a playing characteristic of a player during the time period, calculating a rate of play based on the measuring step, and adjusting a payout of a gaming machine based on the calculating step. The method allows a degree of skill to be used in a purely or partially chance-based game, making such games more attractive to potential players. Games which may be susceptible to this invention include any games that are all or partially based on chance or luck, such as slot machines, roulette, wheel of fortune, keno, etc. Games of skill may also benefit from the present invention.

11 Claims, 6 Drawing Sheets

METHOD AND APPARATUS FOR CASINO MACHINE GAMING SYSTEM

CROSS-REFERENCE TO PRIOR APPLICATIONS

This application is a continuation-in-part of prior application U.S. Ser. No. 9/481,726, filed on Jan. 11, 2000, now U.S. Pat. No. 6,488,580 entitled "METHOD AND APPARATUS FOR CASINO GAMING SYSTEM FOR, E.G., SKILL-BASED GAMES", currently pending.

BACKGROUND OF THE INVENTION

Gambling games have existed since antiquity. Most of these games are based heavily on chance. Some, such as slot machines, are based entirely on chance. The others, such as blackjack and craps, require some skill for "success", where "success" is of course measured against an inherent house advantage.

Games of pure or primarily skill have not previously been successfully used in casinos because the skill element can overwhelm the inherent house advantage, thus making such-games unprofitable. Games of skill, however, can be highly attractive to players who enjoy the possibility of using their skills and wits to overcome odds against them.

Games of skill, however, are often unattractive to, e.g., slot players, because of the time and energy required to learn the rules and basic strategies of such games. Many slot players would rather play a slot machine because it is much simpler to play, even though they are likely aware that their inherent chance of winning in such a chance-based game is less than in most skill-based games.

SUMMARY OF THE INVENTION

The present invention addresses the needs described above. In particular, the invention allows a degree of skill to be used in a purely or mostly chance-based game, making such games more attractive to potential players. Games which may be susceptible to this invention include any games that are all or partially based on chance or luck, such as slot machines, roulette, wheel of fortune, keno, etc. Games of skill may also benefit from the present invention.

In one aspect, the invention is directed to a method of calculating a payout for a machine based game, comprising: choosing a time period over which a measurement will occur, measuring a playing characteristic of a player during the time period, calculating a rate of play based on the measuring step, and adjusting a payout of a gaming machine based on the calculating step.

Implementations of the method may include one or more of the following. The playing characteristic may be at least one selected from the group consisting of the number of plays per time period and the amount bet per play. The payout may be based on a look-up table, or may be based on an equation having at least one playing characteristic as a variable. The time period may be between about 10 seconds and 5 minutes, such as between about ½ minute and 3 minutes. The rate of play and payout may increase monotonically with the number of plays per time period or with the amount bet per play. The gaming machines may include slot machines, keno machines, poker machines, and blackjack machines. The measuring step may further include measuring the playing characteristics of at least two players, and the payout may then be based on a comparison of the playing characteristics of the at least two players. The house advantage may be maintained at a substantially constant level by adjusting the payout of the gaming machines of the at least two players.

In another aspect, the invention is related to a gaming system, including a central casino server and at least two gaming machines coupled to the central casino server. The central casino server is configured to choose a time period over which a measurement will occur, measure a playing characteristic of a player during the time period, calculate a rate of play based on the measuring step, and adjust a payout of the gaming machine based on the calculating step.

Advantages of the invention include one or more of the following. Games of chance may be made considerably more attractive to players by the introduction of a degree of controllability or skill. Players who would ordinarily not play such games may be highly enticed to play. These advantages and others will become more apparent by the description that follows, including the drawings and claims.

Figure 5:
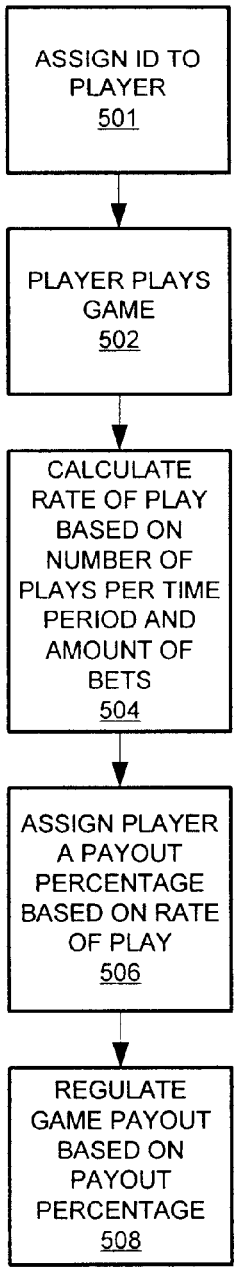
FIG. 5 shows a flowchart of a third embodiment of the method of the present invention, showing an inventive scheme used with a game.

Table I shows an exemplary payout schedule which may be used within the third embodiment of the method of the present invention of FIG. 5.

DETAILED DESCRIPTION OF THE PREFERRED EMBODIMENTS

Figure 1:
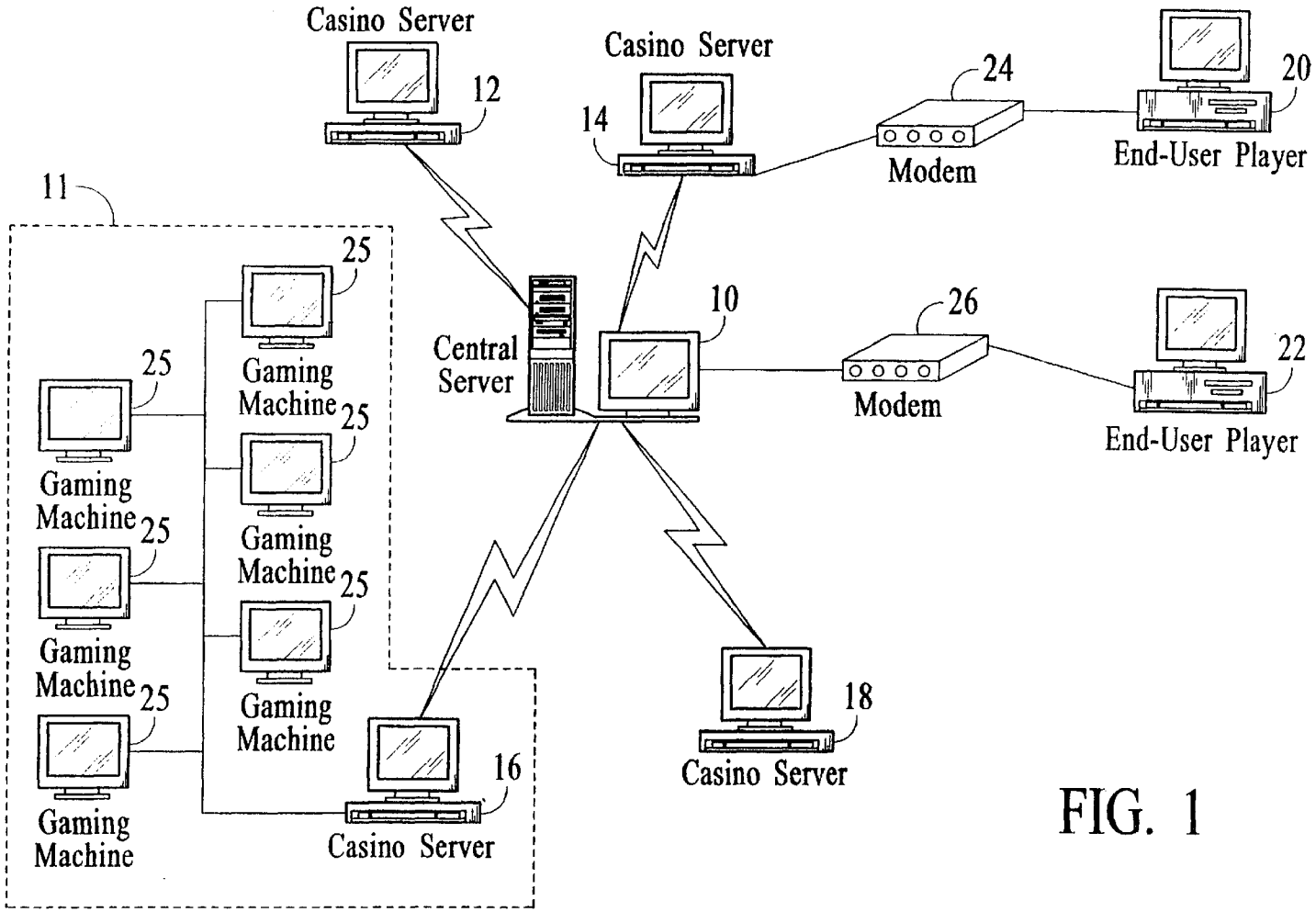
FIG. 1 shows a network layout of a gaming system according to a first embodiment of the system of the present invention.

Referring to FIG. 1, a network layout of a gaming system is shown. A central server 10 is depicted with numerous connections to a plurality of casino servers 12, 14, 16, and 18. Casino server 16 is shown within a casino 11. It will be apparent to one of skill in the art using the teachings of the present specification that variations may be made even of this simple theme. For example, casino servers 12–18 may themselves perform the functions of central server 10, thus eliminating the need for a central server 10. However, advantages may inure to the use of such a central server 10 as will be shown.

Casino servers 12–18, located within or communicatively coupled to a casino such as casino 11, may each service a number of gaming machines 25. Gaming machines 25 will be described in more detail below.

Players not located in a casino may also use the gaming system. For example, in an alternative communications setup, also shown in FIG. 1, casino servers such as casino server 14 may be linked via a modem 24 to an end-user player computer 20. Alternatively, an end-user player computer 22 may be linked directed via a modem 26 to central server 10. Of course, in cases where the gaming machines are used for gambling, security systems should be instituted to ensure that only players located in legal gambling locations could log in and use the system.

A benefit to the above system is that the use of an on-site casino server allows the management of a casino to vary treatment to players if desired such as to high rollers. Such varied treatment is often afforded a casino's best players currently, and this treatment can be continued in methods using the present invention.

Central server 10 performs numerous functions. One of these functions may be to receive all the scores of all the players of a particular game of skill from all casino servers connected to central server 10. These aggregated scores are used to calculate a betting level (described below). Central server 10, for reasons also described below, may also calculate an average score.

Figure 2:
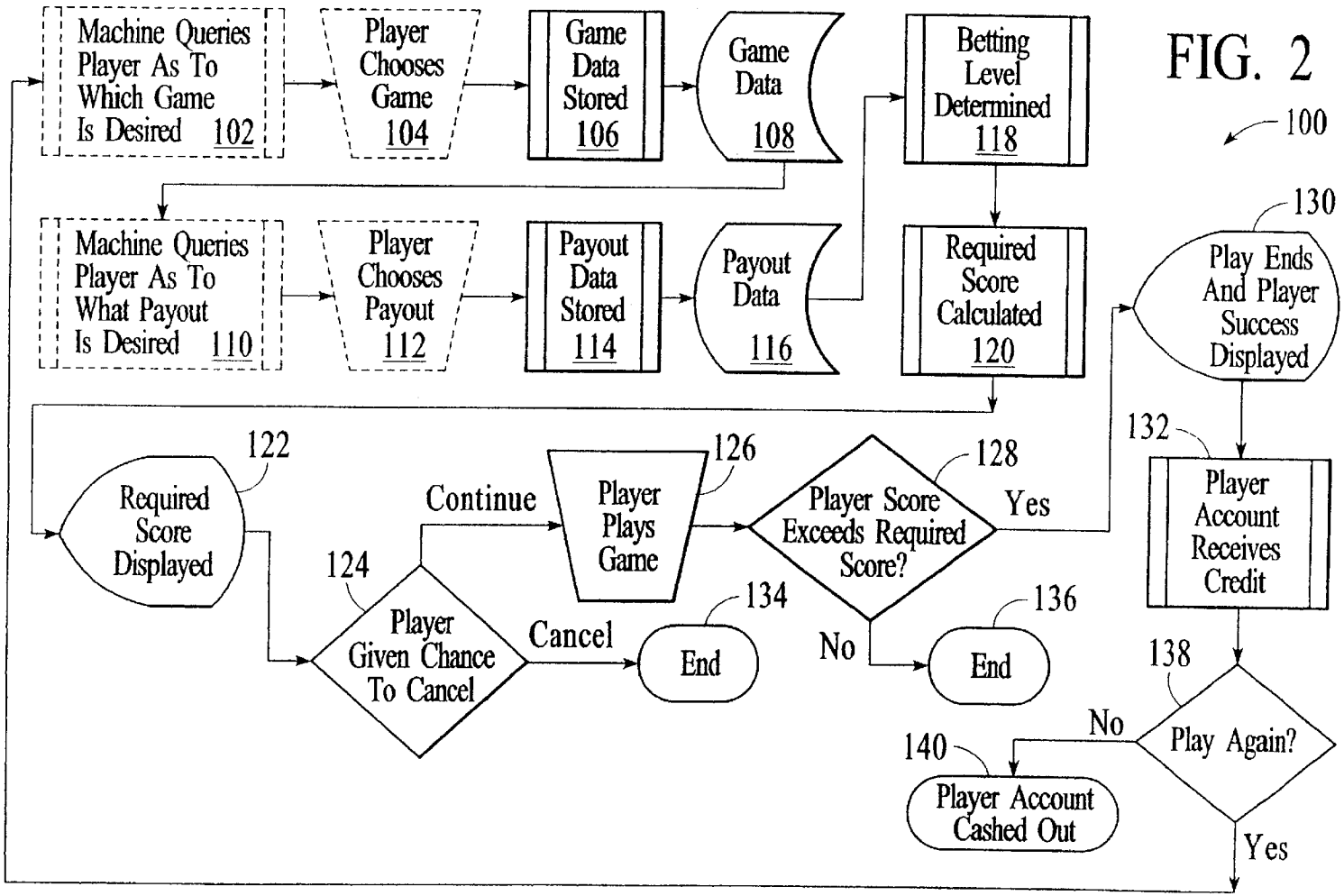
FIG. 2 shows a flowchart of a first embodiment of the method of the present invention.

Referring to FIG. 2, an embodiment of a method 100 according to the present invention is now described. The gaming machine 25 may query the player as to what game is desired to be played (step 102). This step is optional as is indicated by a dotted box. This step would only be used for gaming machines 25 offering a plurality of game choices. Game choices may include blackjack, poker, slots, or games of skill such as arcade games or even sporting games as are common in bars and restaurants. The game choices are only limited by the mechanics of the game console. For convenience, a game is described below which is purely a game of skill. In other words, the player receives a score based only and solely on how skillfully they play the game. Of course, the invention is not to be limited solely to such games.

The player thus chooses which game to play (step 104). Game data is stored as to which game was chosen (step 106). This game data is referred to in the flow chart as game data 108.

The machine may then query the player as to what payout is desired (step 110). This step is also optional because the game data may be fixed at, e.g., 1:1. The player chooses the payout (step 112), and the payout data is stored (step 114) as payout data 116.

The player betting level is determined (step 118). In essence, this determination is simply a storage of the amount the player has wagered on the game.

A required score is then calculated from a number of factors (step 120). This step is also described in more detail below. The factors may include (but are not limited to) the payout desired, the aggregate of player scores, and the house advantage.

The required score is then displayed to the player (step 122), who is then given a chance to cancel (step 124). If the player cancels, the game ends (step 134). If the player does not cancel, then the player plays the game (step 126).

In one embodiment, shown in FIG. 2, if the player achieves a score that is determined to be greater than or equal to the required score (step 128), then the game ends and the success of the player is indicated and displayed (step 130). If the player score does not exceed the required score, then game ends (step 136). Of course, the player may be given a chance to play again if desired. In the case where the player wins, the player's account may be duly credited (step 132) and the player may be given a chance to play again (step 138). If the player chooses to play again, the machine may again query the player as to what game is desired (step 102). If the player does not so choose to play again, the player account may be optionally cashed out (step 140).

Figure 3:
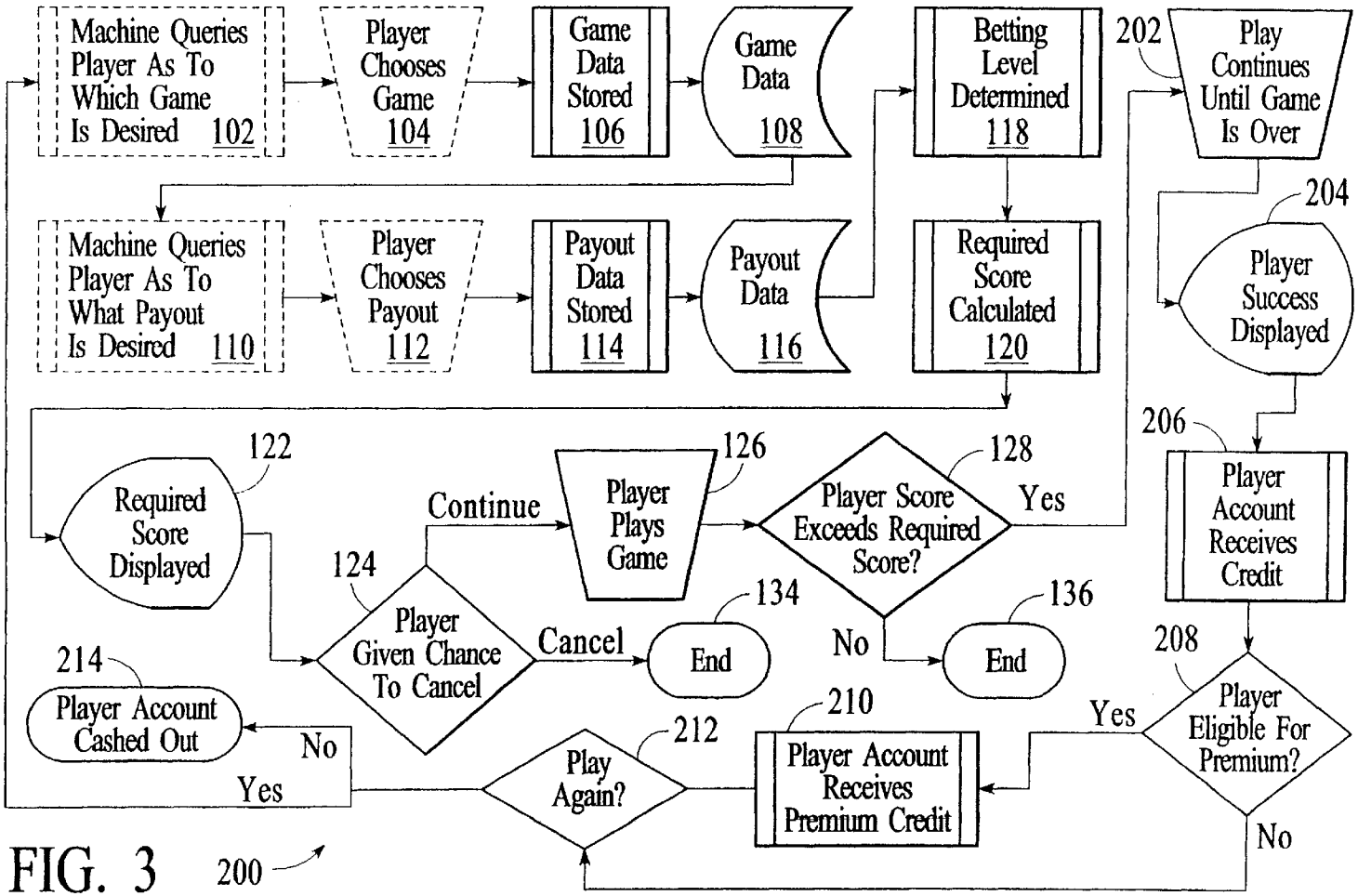
FIG. 3 shows a flowchart of a second embodiment of the method of the present invention.

In a second embodiment, shown in FIG. 3, many of the steps are similar to those of FIG. 2. However, in FIG. 3, if the player score exceeds the required score, play may continue until a natural termination point of the game is reached. At this point, the player may have achieved a score well in excess of the required score. Such an exceptional score may qualify the player for premium prizes such as a progressive jackpot. The progressive jackpot may be funded by losing bets.

Figure 4:
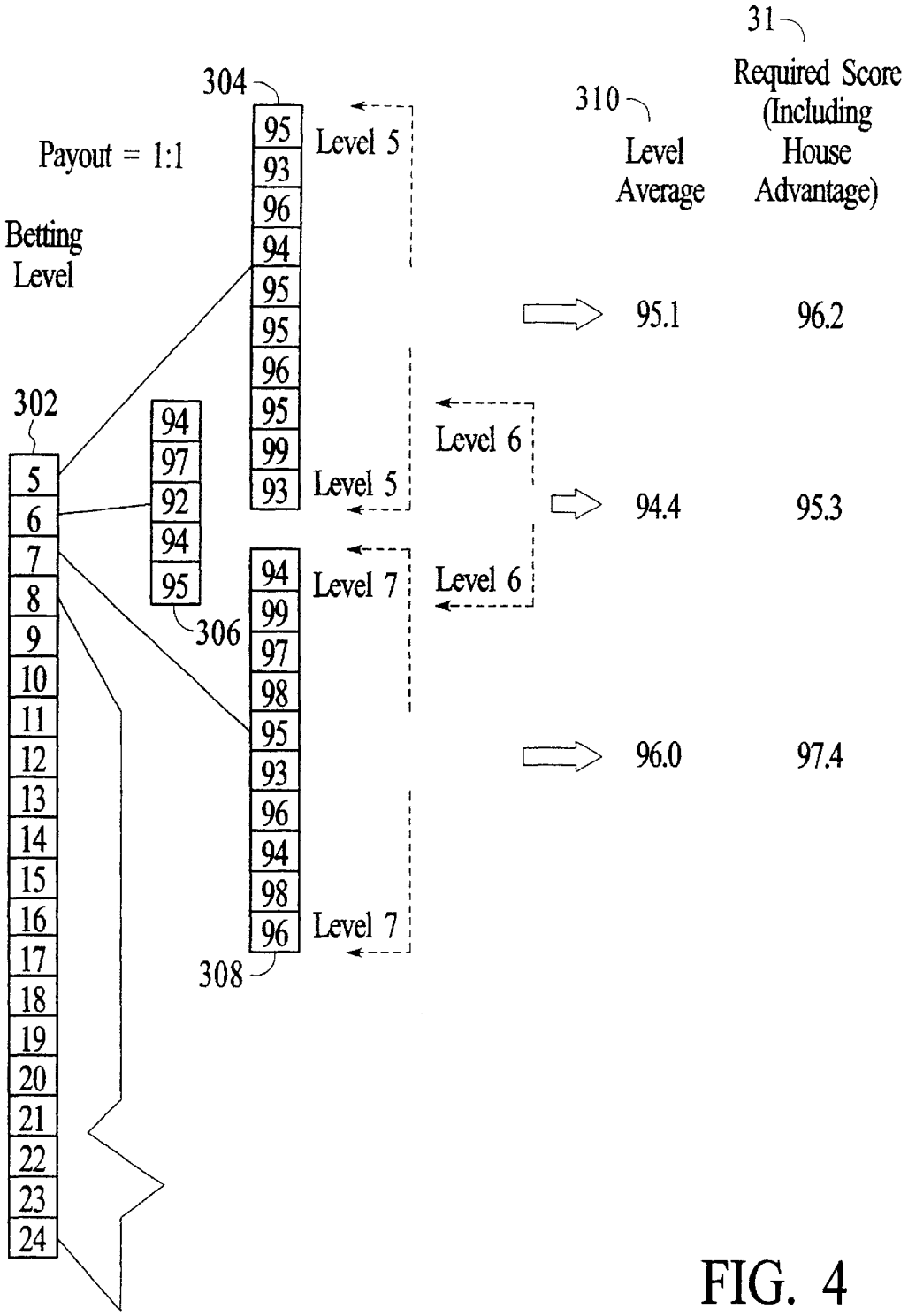
FIG. 4 shows a layout of a betting level scheme, which may be implemented in the system and method according to the embodiments of the invention.

The method whereby betting levels and required scores are determined is now described in more detail. Referring to FIG. 4, an example of a betting level and required score scheme are shown. It should be noted that FIG. 4 is only meant for illustration. A real system would have a far greater number of score entries and betting levels. The required scores shown are merely estimates based on a sample house advantage. A real system may construct a statistical model of the game scores, compute a statistically accurate house advantage, and thus calculate an accurate required score.

As shown in FIG. 4, a number of betting levels 302 are shown. Each betting level has associated with it a list of scores (lists 304, 306, and 308). These lists of scores are lists of the aggregated scores of all the games played associated with a particular betting level. For example, the aggregated scores associated with betting level 5 are shown by list 304, and so on. Of course, the lists and betting levels shown in FIG. 4 are just sample data and do not necessarily represent actual scores.

In the first embodiment of the method described above, it was noted that the game may be halted at the point where the player exceeds the required score. For purposes of the betting level list, the casino server may, in appropriate games, add to the player's score (as reported to the list) the average number of points the player was winning at a moment in time, such as when the game ended, multiplied by a remaining time (if the game is subject to a time limit). Such a facility may increase the overall accuracy of the list.

Given a particular wager, which determines the betting level, the associated list and house advantage may uniquely determine the required score. The method of determination is somewhat arbitrary and depends on the casino. For example, the method may be as simple as taking a median or mean of the list and adding a non-zero house advantage (e.g., 2%). On the other hand, more sophisticated systems take account of the fact that adding a house advantage to a score is not the same as adding the house advantage to a list of player scores.

The required score may also depend on the desired payout, a variable that as noted above may be optionally chosen by the player in some gaming machines. For example, if a player desired a 20:1 payout instead of 1:1, the required score may be correspondingly higher, e.g, the casino server or central server may require that the player score in the top 3% of their betting group (if the correct odds would indicate the top 5%) to account for the required house advantage.

In the case where the player is the first player to place a particular wager or betting level, the average which can be used is the average over all of the lists. Alternatively, an average can be computed based on betting levels close to the new betting level.

In another embodiment, as shown in FIG. 5, a game of pure chance, at least partially chance, or of skill may be subject to a desired amount of "skill". In this embodiment, a game of chance such as a slot machine is played by a player whose identification ("ID") has been logged by the casino in much the same way IDs are logged for "slot clubs" currently. While the embodiment described here discusses a slot machine, herein termed a "machine", the invention is clearly applicable to other such games, including games of chance, games of skill, and games of both skill and chance. This ID is used to ascribe to that player a certain rate of play, this rate of play being used to then calculate a payout unique to that player. In this way, casinos may provide a higher payout to those players who play the most or who play the most often. In this specification, the term "payout" is used to refer to the percentage of the player's money that is returned to the player in the form of winnings. If, for example, a house has a 98% payout, then 98% of the gambling receipts are paid out to players, and the house return is 2%. In the present invention, the house can provide payouts greater than 100% safely, with no fear of monetary losses. Such games would be highly valued by players, increasing the games' attractiveness and thus income potential.

In a general sense, such a game is described in FIG. 5. Step 501 concerns retrieval or assignment of the player's ID. This step does not necessarily entail obtaining the name, address, etc., from the player, but rather is a step of logging the player in to the system so that the player's rate of play can be compared with other player's rates of play. The ID may be determined, in one embodiment, by insertion of a card having a magnetic strip that bears the relevant details of the player. So long as this card is inserted in the machine, the players actions will be assigned to the associated player ID. Of course, in some situations, a player may switch seats or machines and not retrieve their card from the machine. In this event, the networked system simply adapts to the new player after a preset time constant whose nature is described later. Also in this event, the new player's playing characteristics are written to the card after they are determined.

It should be clear that the card concept itself is not required in the practice of the invention. The card concept may be used when it is desired to immediately obtain various rate of play characteristics of a player. In general, if the time constant of the networked system is short enough, the system can adapt to a new player within a minute or so of the player's start of play on a new machine.

Step 502 is the actual play of the player. The player can be playing games based entirely or almost entirely on luck or chance, such as slots, or games based at least partially on chance, such as blackjack, etc.

The "time constant" of the system is defined as the time between samples of the networked system of a given machine. For example, one machine may calculate the rate of play given one minute of play: if a player is playing a slot machine and pulls the handle five times in one minute, and bets $1.25 per spin, the player's normalized rate of play is 300 plays per hour at $1.25 per play.

Step 504 is the step of calculating the player's rate of play. This step is explained in more detail in FIG. 6 and in Table I. Generally, this step ascribes a certain rate of play to a player based on the number of plays per set time period, such as per hour, and amount played. Of course, either or both of these factors, as well as others, may alternatively be used singly or together. A general look-up table may be used, as in Table I, or an analytic equation may be used to determine the payout. In Table I, for example, a slow player who doesn't bet a lot, such as the player who plays 100 times per hour and for only 1 unit (arbitrary) per bet, may be assigned a payout of 97%. However, a player who plays a lot, e.g., a thousand times per hour, and who bets 5 units (arbitrary) per bet, may be assigned the highest payout, e.g., 106%. Of course, it should also be noted that the values in Table I are preferably not static—i.e., they change as players' rates change. The cumulative average of all players, at any given point in time, should be associated with the chosen house advantage. If the house advantage is chosen to be 2%, then the cumulative house average over all players should be 98%. Thus, the values in Table I should be considered to be on a scaled curve. If all the players at a given casino are playing at rates of 1000 plays per hour and betting the maximum amount, then the entire Table I should be scaled up to account for this fact. The result of the scaling up should be that the overall house advantage is achieved.

In another embodiment, a degree of freedom may be removed from such a table by programming the algorithm or system to group and compare players according to a specific player characteristic, such as how much they bet. In other words, the system may only compare players who have substantially the same value for one or more player characteristics, such as those who bet substantially equal amounts. This may allow for considerable simplification of the algorithm.

Figure 6:
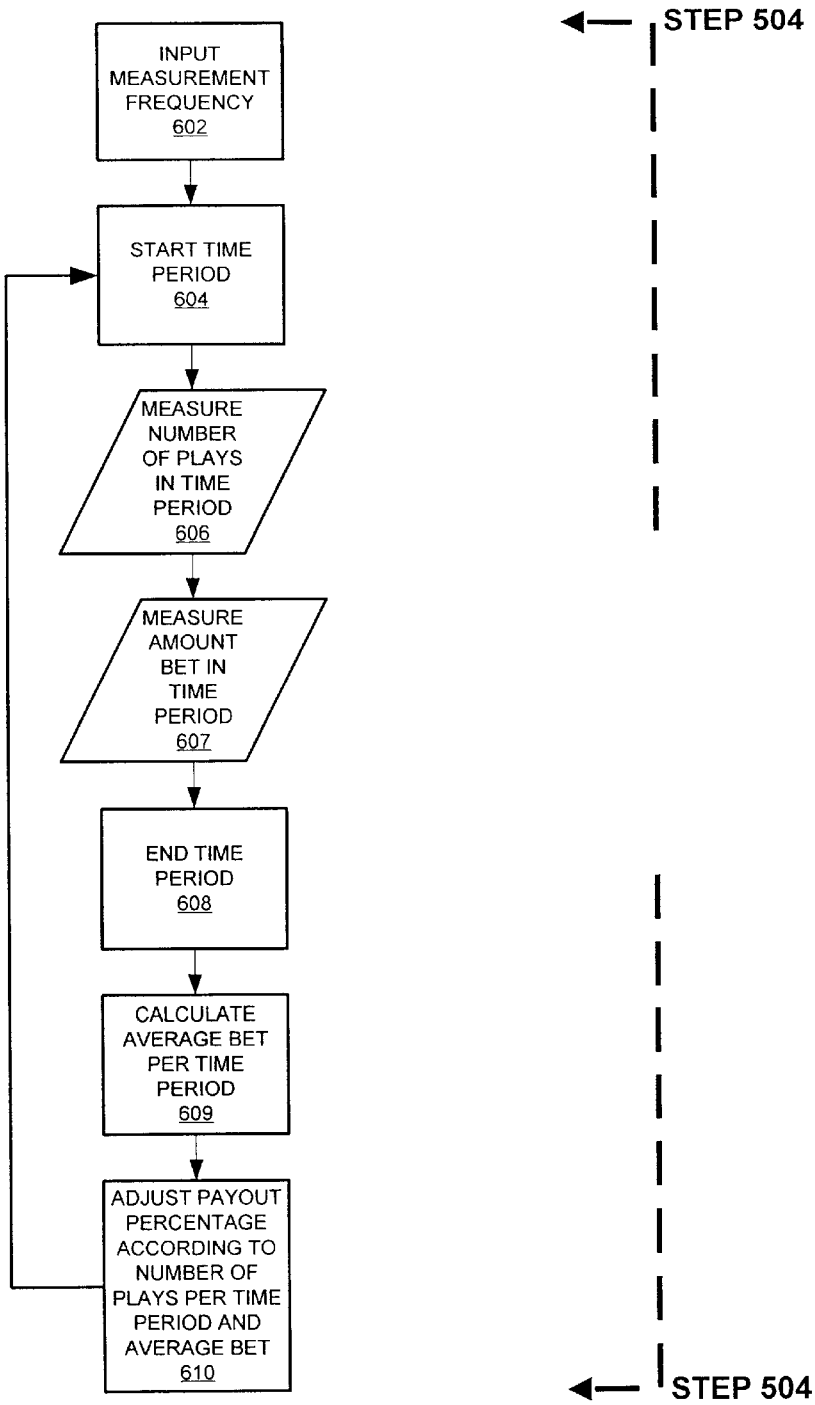
FIG. 6 shows a flowchart of a step which may be used within the third embodiment of the method of the present invention of FIG. 5.

FIG. 6 depicts a flowchart version of the general algorithm. A measurement frequency is determined (step 602) by the casino. This frequency may be longer, for ease of calculation efficiency, or shorter, for more accurate real-time determination of the correct payout. A time period is started (step 604). The number of plays is measured during this time period (step 606). The amount bet is determined for the same time period (step 606). The time period may then end as determined by the measurement frequency (step 608). An average bet may be determined for the time period (step 609). The payout percentage may then be adjusted according to the calculated values (step 610). The whole process may then repeat (step 604).

However the payout percentage is determined, the player ID may then be assigned (step 506) a payout percentage based on the rate of play determined in Step 504. This payout percentage is applied to the machine such that the same pays out the percentage while the player with the particular player ID is playing the machine, as determined by the card inserted in the machine or by the instantaneous rate calculated. The method by which a machine is programmed to pay out a specified percentage is known.

In another embodiment, rather than increasing the payout percentage, the player may simply be awarded a prize, such as cash or a tangible gift, for achieving a high rate of play.

Of course, it will be clear to one of skill in the art that the above description only describes certain embodiments of the invention and accordingly that the scope of the invention is limited only by the scope of the claims appended hereto, and equivalents thereof. For example, while many steps are shown in the accompanying flowcharts and figures, not all the steps are necessarily required for each practice of the invention. Moreover, where the term "game of chance" it employed, it is intended to encompass not only games entirely of chance, such as slots, but also games partially of chance, such as roulette. Further, while an embodiment describing a slot machine has been disclosed, the invention is applicable to virtually any game.

TABLE I

| | BET PER PLAY | | | | |
|---|---|---|---|---|---|
| PLAYS PER HOUR | 1 | 2 | 3 | 4 | 5 |
| 100 | 97 | 97 | 98 | 99 | 100 |
| 200 | 98 | 99 | 100 | 101 | 102 |

TABLE I-continued

| | BET PER PLAY | | | | |
|---|---|---|---|---|---|
| PLAYS PER HOUR | 1 | 2 | 3 | 4 | 5 |
| 300 | 99 | 100 | 101 | 102 | 103 |
| 400 | 100 | 100 | 101 | 102 | 103 |
| 500 | 101 | 102 | 103 | 104 | 105 |
| 600 | 102 | 103 | 104 | 105 | 105 |
| 700 | 103 | 104 | i05 | 106 | 106 |
| 800 | 104 | 104 | 105 | 108 | 108 |
| 900 | 105 | 105 | 106 | 106 | 108 |
| 1000 | 105 | 105 | 106 | 106 | 106 |

What is claimed is:

1. A method of calculating a payout for a multi-player machine based game, comprising:

a. choosing a time period over which a measurement will occur;

b. measuring playing characteristics of at least two players during the time period, each playing a gaming machine;

c. calculating relative rates of play of the at least two players based on the measuring step; and d. adjusting payouts of the gaming machines based on the calculating step and further on a comparison of the playing characteristics of the at least two players.

2. The method of claim 1, wherein the playing characteristic is at least one selected from the group consisting of: the number of plays per time period and amount bet per play.

3. The method of claim 2, wherein the payout is based on an equation having the playing characteristic of at least one of the two players as a variable.

4. The method of claim 2, wherein the rate of play and payout increase monotonically with the number of plays per time period.

5. The method of claim 2, wherein the rate of play and payout increase monotonically with the amount bet per play.

6. The method of claim 1, wherein the payout is based on a look-up table.

7. The method of claim wherein the time period is between about 10 seconds and 5 minutes.

8. The method of claim 7, wherein the time period is between about ½ minute and 3 minutes.

9. The method of claim 1, wherein the gaming machine is one selected from the group consisting of: slot machines, keno machines, poker machines, and blackjack machines.

10. The method of claim 1, further comprising maintaining a house advantage at a substantially constant level by adjusting the payout of the gaming machines of the at least two players.

11. A gaming system, comprising:

a central casino server;

at least two gaming machines coupled to the central casino server;

the central casino server configured to:

a. choose a time period over which a measurement will occur;

b. measure playing characteristics of at least two players during the time period, each playing a gaming machine;

c. calculate relative rates of play of the at least two players based on the measuring step; and d. adjust a payout of the gaming machine based on the calculating step and further on a comparison of the playing characteristics of the at least two players.

* * * * *